US007784153B2

(12) United States Patent
Lin

(10) Patent No.: US 7,784,153 B2
(45) Date of Patent: Aug. 31, 2010

(54) HINGE APPARATUS

(75) Inventor: Ming-Han Lin, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 454 days.

(21) Appl. No.: 11/987,033

(22) Filed: Nov. 27, 2007

(65) Prior Publication Data

US 2009/0133217 A1 May 28, 2009

(51) Int. Cl.
*E05F 1/08* (2006.01)

(52) U.S. Cl. ..... 16/303; 16/327; 16/319; 16/54; 16/50

(58) Field of Classification Search ..... 16/337–339, 16/342, 330, 303, 374, 376, 377, 340, 50, 16/54, 319, 327, 352; 361/679.08, 679.12, 361/679.15, 679.27; 455/90.3, 575.1, 575.3, 455/575.8; 379/433.12, 433.13; 348/373, 348/333.01, 333.06, 794
See application file for complete search history.

(56) References Cited

U.S. PATENT DOCUMENTS 5,109,571 A * 5/1992 Ohshima et al. ..... 16/307
5,996,132 A * 12/1999 Sorimachi ..... 4/236
6,859,979 B2 * 3/2005 Egger et al. ..... 16/327
7,117,563 B2 * 10/2006 Chen et al. ..... 16/330
7,257,862 B2 * 8/2007 Bassi ..... 16/342
7,383,616 B2 * 6/2008 Duan et al. ..... 16/303
7,404,235 B2 * 7/2008 Duan et al. ..... 16/330
7,484,266 B1 * 2/2009 Yang ..... 16/54
7,565,718 B2 * 7/2009 Duan et al. ..... 16/330
7,596,830 B2 * 10/2009 Yin et al. ..... 16/303
7,631,397 B2 * 12/2009 Yin et al. ..... 16/330
2009/0064462 A1 * 3/2009 Yin et al. ..... 16/330

* cited by examiner

*Primary Examiner*—Chuck Y. Mah
(74) *Attorney, Agent, or Firm*—Rosenberg, Klein & Lee

(57) ABSTRACT

A hinge apparatus includes a hinge and a damper and defines an axis direction. The damper includes a fixing housing defining an accepting hole therethrough along the axis direction, a rotating nut accepted in the accepting hole and defining an axis hole therethrough, a damping body accepted in the accepting hole and passing through the axis hole, two gaskets located over and under the rotating nut respectively, and a pushing body capable of pushing the damping body to rotate. Two rotating grooves are opened in a sidewall of the axis hole and extending helically along axis direction. Two sliding blocks are arranged on an outer surface of the damping body and extending helically along the axis direction, the sliding block engaging with the rotating groove. Damping oil is filled between the gaskets, the fixing housing and the damping body.

9 Claims, 5 Drawing Sheets

HINGE APPARATUS

BACKGROUND OF THE INVENTION

1. Field of the Invention

This present invention relates to a hinge apparatus, and more particularly to a hinge apparatus preferably applicable to folding or unfolding an electric device such as a folding mobile phone, a portable computer and an electric pocket notebook.

2. The Related Art

Conventionally, a portable apparatus, such as a portable computer and a folding mobile phone, has a body and a display joined by two hinges arranged in two sides of the portable apparatus.

Referring to FIG. 1, a traditional hinge 10 includes a housing 3, a sliding cam 5, a rotating cam 6, a spring 4, a shaft 7, an E-ring 8 and a washer 9. Two curving surfaces 51 are formed in an upper end of the sliding cam 5 and show a V-shape. Two sliding portions 61 are formed in a lower end of the rotating cam 6. The sliding cam 5 and the rotating cam 6 are accepted in the housing 3. The two sliding portions 61 are rotatably against the curving surfaces 51 of the sliding cam 5. The washer 9 covers the bottom of the housing 3. The spring 4 is accepted in the housing 3. One end of the spring 4 is against the washer 9, and the other end of the spring 4 is against a lower end of the sliding cam 5. A lower end of the shaft 7 forms a ringlike groove. The shaft 7 passes through the rotating cam 6, the sliding cam 5, the spring 4 and the washer 9, and the E-ring 8 is accepted in the ringlike groove of the shaft 7.

The rotating cam 6 is fixed with the display of the portable computer, and the housing 3 is fixed with the body of the portable computer. Generally, the two traditional hinges 10 are arranged in the two sides of the portable computer to link the body and the display. When the portable computer is unfolded or folded, the sliding portions 61 slides along the curving surfaces 51 quickly to a lower point of the curving surfaces 51. If the rotating speed of the display around the body is quick, the display and the body are easy to be destroyed.

SUMMARY OF THE INVENTION

Accordingly, an object of the invention is to provide a hinge apparatus which meets the technical requirements in the above-mention hinge.

The hinge apparatus includes a hinge and a damper. The hinge is capable of producing and releasing an elastic force by rotating. The damper arranged coaxially with the hinge includes: a fixing housing, defining an accepting hole therethrough along an axis thereof; a rotating nut, accepted in the accepting hole of the fixing housing, the rotating nut defines an axis hole therethrough along an axis thereof, two rotating grooves opened in a sidewall of the axis hole and extending helically along the axis of the rotating nut; a damping body, accepted in the accepting hole of the fixing housing and passing through the axis hole of the rotating nut, two sliding blocks arranged on an outer surface of the damping body and extending helically along the axis of the damping body, the sliding block sliding along the corresponding rotating groove of the rotating nut; two gaskets, accepted in the accepting hole around the damping body, and the gaskets are located over and under the rotating nut respectively, damping oil filled between the gaskets, the fixing housing and the damping body; and a pushing body capable of pushing the damping body to rotate under the elastic force of the hinge, then the rotating nut sliding along the axis of the damping body.

As described above, when the pushing body pushes the damping body rotating, the rotating nut slides along the axis of the damping body by the sliding block mating with the corresponding rotating groove, then the rotating nut pushes the damping oil to produce a damping force. Therefore, while the electric device is unfolded or folded, the damper will prevent the display from closing or separating the housing quickly to destroy the electric device.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
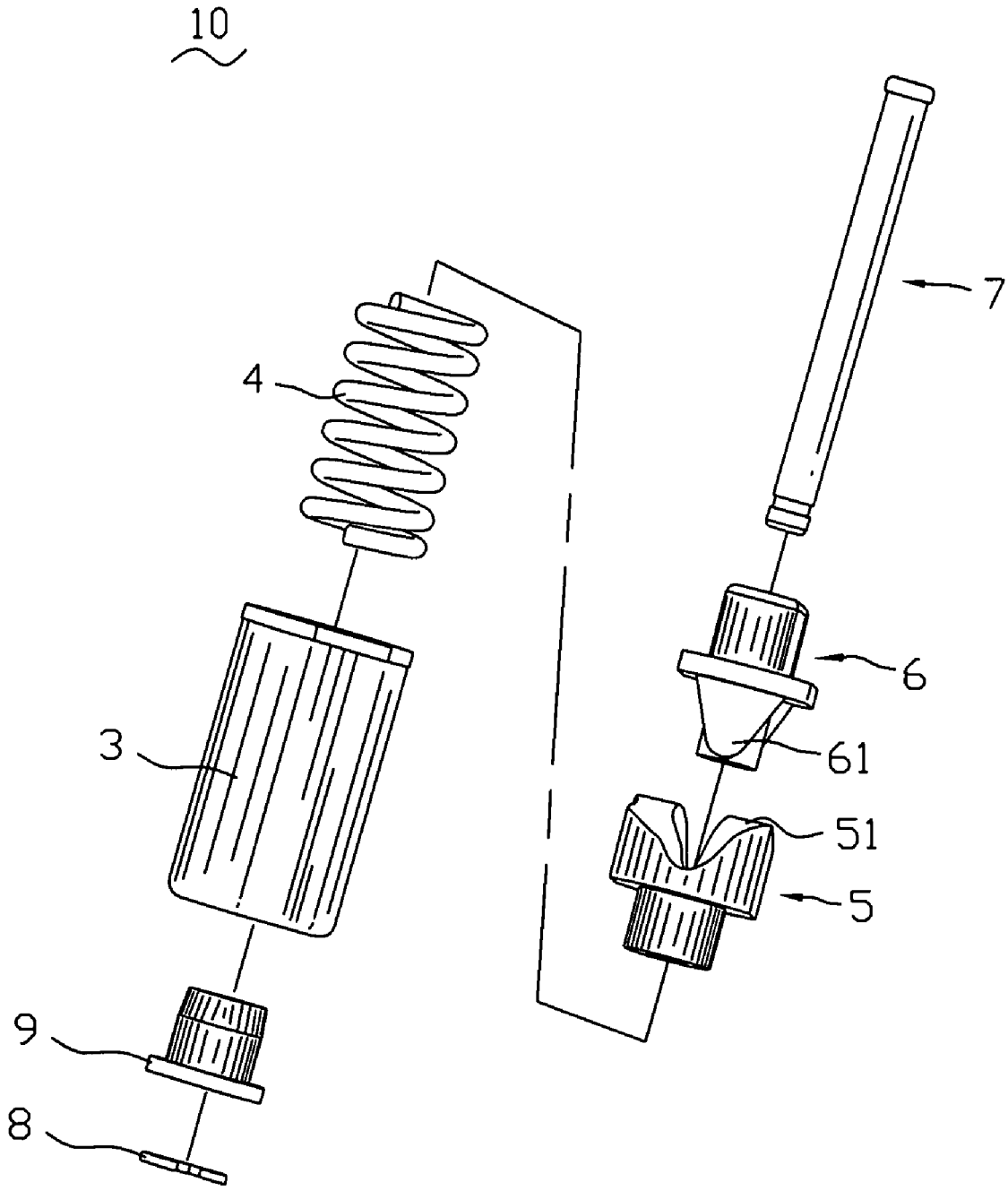
FIG. 1 (Prior Art)
FIG. 1 is an exploded perspective view of a traditional hinge apparatus.
Figure 2:
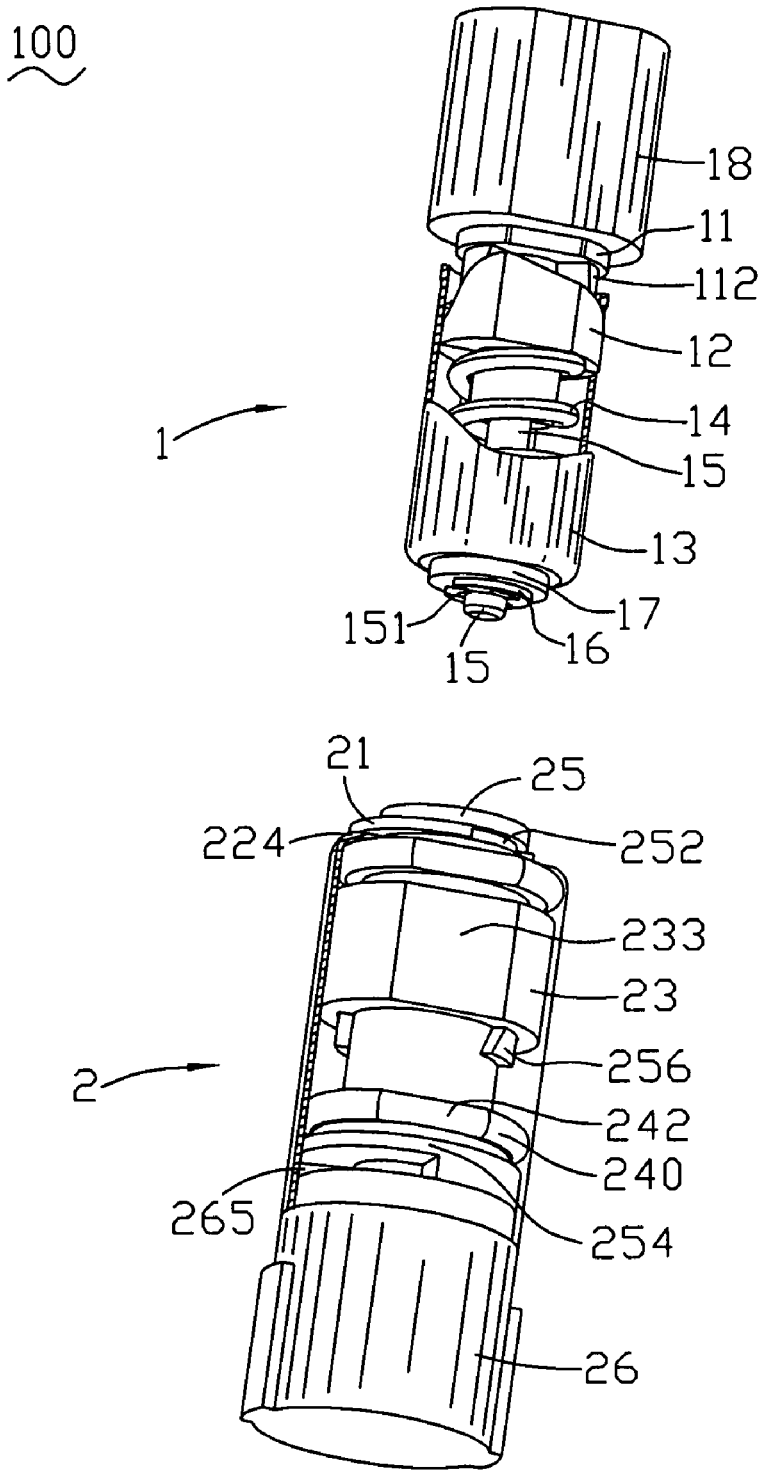
FIG. 2 is a perspective view of a hinge apparatus according to the present invention, a sleeve and a fixing housing of the hinge apparatus are dissected partly.
Figure 3:
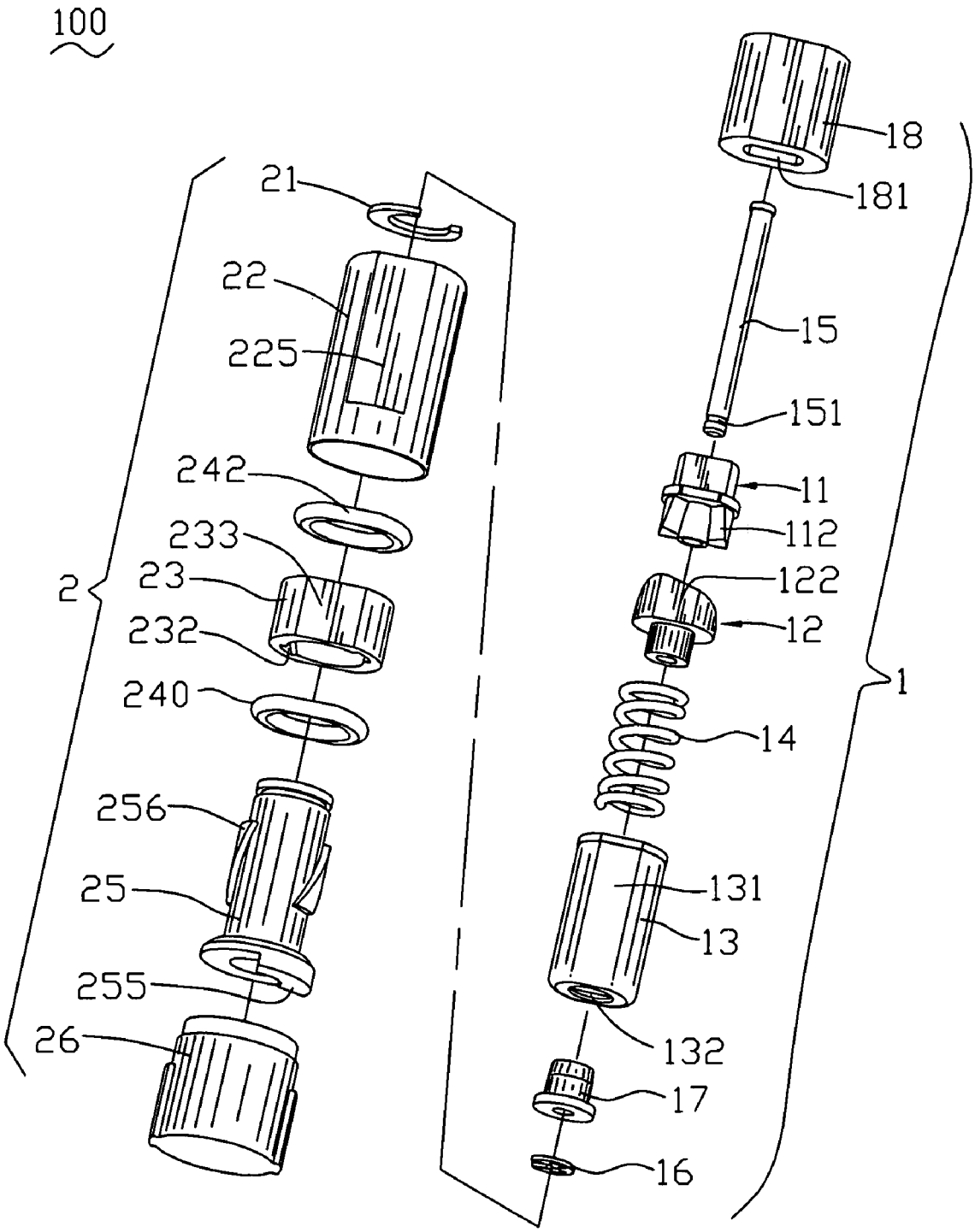
FIG. 3 is an exploded perspective view of the hinge apparatus.

Please refer to FIGS. 2 and 3, a hinge apparatus 100 according to the invention is shown. The hinge apparatus 100 includes a hinge 1 and a damper 2. The damper 2 includes a fixing housing 22, a damping body 25, a rotating nut 23, a pushing body 26, a C-ring 21 and two gaskets 240. The fixing housing 22 is cannular. The damping body 25, the rotating nut 23, a pushing body 26, a C-ring 21 and the gaskets 240 are accepted in the fixing housing 22.

Figure 4:
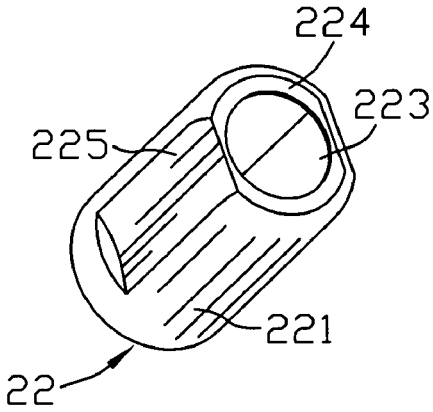
FIG. 4 is a perspective view showing the fixing housing of the hinge apparatus.
Figure 5:
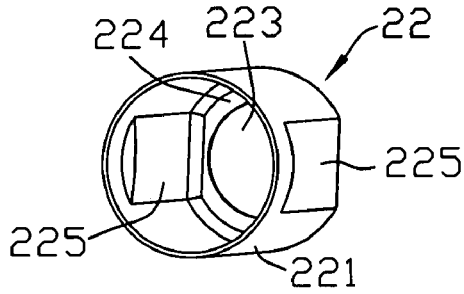
FIG. 5 is another perspective view of the fixing housing in FIG.4.

Referring to FIGS. 4 and 5, the fixing housing 22 has an accepting hole 223 passing through two ends thereof and along the axis direction thereof, a resisting ring 224 is formed at the top end of the fixing housing 22. Two fixing sides 225 protrude inwards into the accepting hole 223 from two opposite sides of the fixing housing 22 and have a distance to the bottom of the fixing housing 22.

Figure 6:
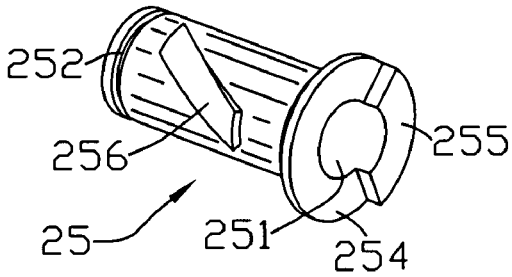
FIG. 6 is a perspective view of a damping body of the hinge apparatus.
Figure 7:
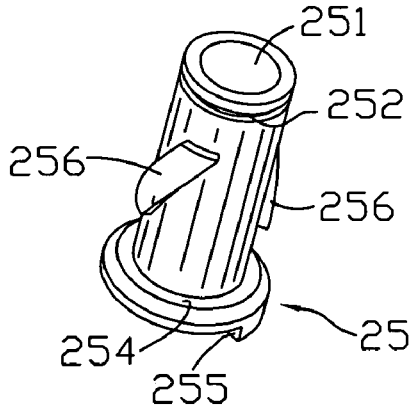
FIG. 7 is another perspective view of the damping body.

Please refer to FIGS. 6 and 7, the damping body 25 having a column shape is inserted into the accepting hole 223. An annular groove 252 is opened in an upper end of an outer surface of the damping body 25. A bottom base 254 is formed at the bottom of the damping body 25. A rotating axis hole 251 is opened along the axis direction of the damping body 25 and passes through two ends of the damping body 25. A protruding block 255 is arranged at one side of the bottom of the bottom base 254. Two sliding blocks 256 are arranged on an outer surface of the damping body 25 and extend helically along the axis of the damping body 25.

Figure 8:
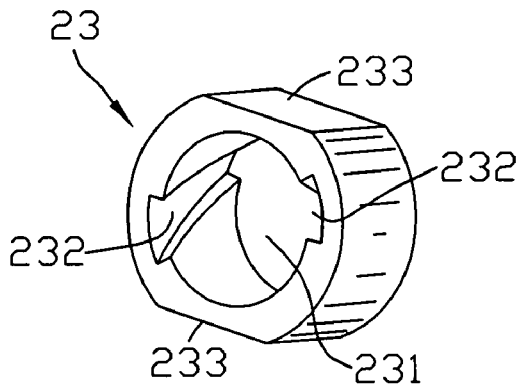
FIG. 8 is a perspective view of a rotating nut of the hinge apparatus.

In FIG. 8, the rotating nut 23 shows a column shape, an axis hole 231 is opened along the axis direction of the rotating nut 23. Two rotating grooves 232 extending helically are opened in a sidewall of the axis hole 231 and extend helically along the axis of the rotating nut 23. The two gaskets 240 shown in FIG. 3 has a ring shape, two planes 242 are formed in the outside of the gasket 240.

The axis hole 231 of the rotating nut 23 accepts the damping body 25. The sliding block 256 is accepted in the corresponding rotating groove 232. When the damping body 25 is pushed to rotate in the axis hole 231 of the rotating nut 23, the two sliding blocks 256 slide in the rotating grooves 232 along the axis direction. Two fixing planes 233 are formed in the outside of the rotating nut 23. The two gaskets 240 cover the damping body 25, one of the gaskets 240 is arranged between the bottom base 254 and the rotating nut 23, and the other gasket 240 is arranged on the top of the damping body 25. The two gaskets 240, the rotating nut 23 and the damping body 25 are accepted in the fixing housing 22. The planes 242 of the gasket 240 and the fixing planes 233 of the rotating nut 23 resist against the fixing sides 225 of the fixing housing 22. The top end of the damping body 25 projects from the accepting hole 223 of the fixing housing 22. The C-ring 21 is inserted into the annular groove 252, and the diameter of the C-ring 21 is wider than the inner diameter of the resisting ring 224. The bottom base 254 resists the bottom of the fixing sides 225. When the sliding blocks 256 are pushed to rotate along the rotating grooves 232, the gaskets 240 and the rotating nut 23 slide along the axis direction of the fixing housing 22 in the fixing housing 22.

Figure 9:
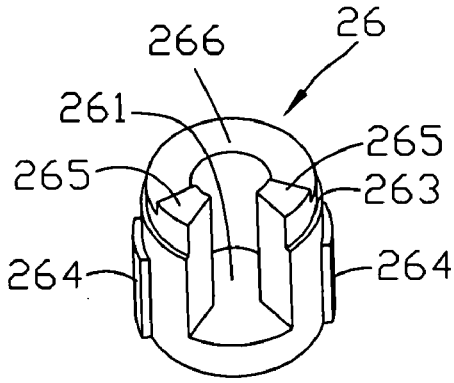
FIG. 9 is a perspective view of a damping base of the hinge apparatus.
Figure 10:
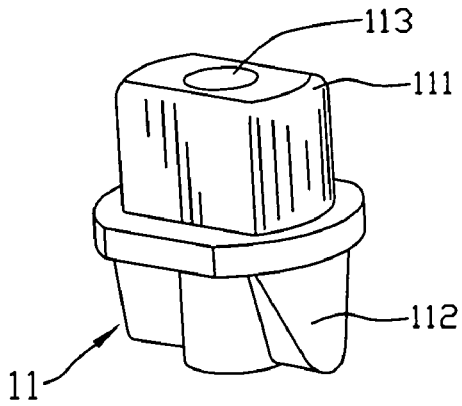
FIG. 10 is a perspective view of a rotating cam of the hinge apparatus.
Figure 11:
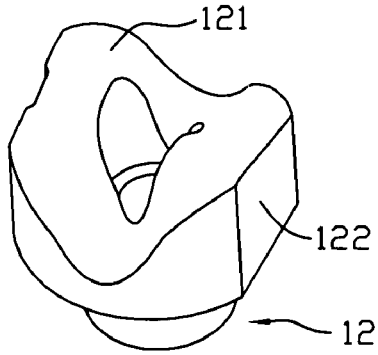
FIG. 11 is a perspective view of a sliding cam of the hinge apparatus.

The pushing body 26 is arranged under the damping body 25, shown in FIG. 3. The pushing body 26 shows a cylinder shape in FIG. 9. A fool-proofing groove 261 is opened in the middle of the pushing body 26. The diameter of an upper portion of the pushing body 26 equals to the inner diameter of the fixing housing 22, and the diameter of a lower portion of the pushing body 26 is wider than the upper portion of the damping base 26. A resisting surface 263 is formed between the upper portion and the lower portion of the pushing body 26. Two ribs 264 are formed in the outside of the pushing body 26. A C-surface 266 is formed in the top of the pushing body 26. Two projections 265 are arranged in two ends of the C-surface 266. The upper portion of the pushing body 26 is pushed into the fixing housing 22. The resisting surface 263 resists the bottom of the fixing housing 22. The protruding block 255 resists the C-surface 266 and can rotate along the C-surface 266 between the two projections 265. The ribs 264 are accepted in grooves opened in a body or a display of an electric device to fix the pushing body 26 in the electric device. Damping oil is filled between the two gaskets 240.

In FIG. 3, the hinge 1 includes a rotating cam 11, a sliding cam 12, a sleeve 13, a spring 14, a shaft 15, an E-ring 16, a washer 17 and a rotating element 18. Two restricting sides 131 are formed in the outside of the sleeve 13. A circular opening 132 is opened in the bottom of the sleeve 13.

The washer 17 is inserted into the sleeve 13 from the circular opening 132 and against the bottom of the sleeve 13. The spring 14 is accepted in the sleeve 13 and above the washer 17. The sliding cam 12 is accepted in the sleeve 13 and above the washer 17. The top of the sliding cam 12 has two curving surfaces 121. Two stop sides 122 are formed in the side of the sliding cam 12 and resist the inside of the restricting sides 131. The lower end of the rotating cam 11 forms two sliding portions 112 which show a V-shape and are against the curving surfaces 121. The shaft 15 has a ringlike groove 151 formed in the bottom. The shaft 15 passes through the rotating cam 11, the sliding cam 12, the spring 14 and the washer 17, the bottom of the shaft 15 extends out from the bottom of the sleeve 13. The E-ring 16 is accepted in the ringlike groove 151. A connecting portion 111 forms in the top of the rotating cam 11 for the shaft 15 passing therethrough. The connecting portion 111 of the rotating cam 11 protrudes from the bottom of the rotating element 18. The rotating element 18 is fixed in the body or the display of the electric device, correspondingly, the sleeve 13 is fixed in the display or the body of the electric device. When the rotating element 18 rotates with the body, the rotating element 18 drives the rotating cam 11, the sliding portions 112 rotate along two rising portions of the curving surfaces 121, and then the sliding portions 112 rotate along two dropping portions of the curving surfaces 121.

In this embodiment, the rotating element 18 of the hinge 1 and the pushing body 26 of the damper 2 are arranged in the body, and the sleeve 13 of the hinge 1 and the fixing housing 22 of the damper 2 are arranged in the display of the electric device. When the electric device is folded or unfolded, the rotating element 18 and the pushing body 26 are rotated with the body, the rotating element 18 drives the rotating cam 11, the sliding portions 112 rotate along the rising portion of the curving surfaces 121, and the projections 265 rotate along the bottom base 254, the projections 265 do not drive the protruding block 255, then the sliding portions 112 rotate along the dropping portion of the curving surfaces 121, for the spring 14 resists the fixing cam 12, the sliding portions 112 can slide along the dropping portion of the curving surfaces 121 quickly, and the projection 265 pushes the protruding block 255, for the damping oil is filled between the gaskets 240, the damping body 25 pushes the damping oil to rotate slowly in the fixing housing 22, and make the sliding portions 112 sliding along the dropping portions or the rising portions of the curving surfaces 121 tardily, so the electric device is folded or unfolded softly, the electric device will not destroyed.

As described above, when the pushing body 26 pushes the damping body 25 to rotate, the rotating nut 23 slides along the axis of the damping body 25 by the sliding block 256 mating with the corresponding rotating groove 232, then the rotating nut 23 pushes the damping oil to produce a damping force. Therefore, while the electric device is unfolded or folded, the damper 2 will prevent the display from closing or separating the housing quickly to destroy the electric device.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A hinge apparatus, comprising:

a hinge, capable of producing and releasing an elastic force by rotating; and a damper arranged coaxially with the hinge, having a fixing housing, defining an accepting hole therethrough along an axis thereof, a rotating nut, accepted in the accepting hole of the fixing housing, defining an axis hole therethrough along an axis thereof, two rotating grooves opened in a sidewall of the axis hole and extending helically along the axis of the rotating nut, a damping body, accepted in the accepting hole of the fixing housing and passing through the axis hole of the rotating nut, two sliding blocks arranged on an outer surface of the damping body and extending helically along the axis of the damping body, each sliding block slidably engaging with the corresponding rotating groove of the rotating nut, two gaskets, accepted in the accepting hole around the damping body, and located over and under the rotating nut respectively, damping oil filled between the gaskets, the fixing housing and the damping body, and a pushing body capable of pushing the damping body to rotate under the elastic force of the hinge, then the rotating nut sliding along the axis of the damping body.

2. The hinge apparatus as set forth in claim 1, wherein the bottom of the damping body disposes a protruding block at one side thereof, the top of pushing body defining two projections at one side thereof, the projections being rotatable against two side surfaces of the protruding block for pushing the protruding block.

3. The hinge apparatus as set forth in claim 2, wherein the top of the pushing body defines a C-surface, the two projections arranged in two ends of the C-surface.

4. The hinge apparatus as set forth in claim 2, wherein the outside of the pushing body defines two ribs for mating with an electric device.

5. The hinge apparatus as set forth in claim 2, wherein the bottom of the damping body forms a bottom base, two opposite sides of the fixing housing protrude inwards into the accepting hole to form two fixing sides, the fixing side has a distance to the bottom of the fixing housing, and the bottom base is against the bottom of the fixing sides.

6. The hinge apparatus as set forth in claim 5, wherein the protruding block is formed at the bottom of the bottom base.

7. The hinge apparatus as set forth in claim 5, wherein the top of damping body defines an annular groove therearound and protrudes from the top of the fixing housing for being locked.

8. The hinge apparatus as set forth in claim 5, wherein the outside of the rotating nut defines two fixing planes, and the outside of the two gaskets defines two planes for mating with the two fixing sides of the fixing housing.

9. The hinge apparatus as set forth in claim 1, wherein the hinge includes a sleeve, a sliding cam, a rotating cam and a spring received in the sleeve, the spring is arranged between one end of the sleeve and one end of the sliding cam, the sliding cam and the rotating cam mate each other for compressing or releasing the spring, and the top of the rotating cam protrudes from the top of the sleeve for engaging with a rotating element.

* * * * *